United States Patent [19]

Bey

[11] 4,022,503

[45] May 10, 1977

[54] PORTABLE SECURITY LOCK

[76] Inventor: Henry A. Bey, Box 88, Breckenridge, Minn. 56520

[22] Filed: Oct. 16, 1975

[21] Appl. No.: 622,807

[52] U.S. Cl. ..... 292/264; 24/116 R; 24/135 N; 292/288

[51] Int. Cl.[2] ..... E05C 17/36

[58] Field of Search ..... 24/68 CT, 68 TT, 69 T, 24/69 TT, 70 CT, 70 TT, 71.1, 73 CE, 81 AB, 116 R, 116 A, 135 R, 135 L, 135 M, 135 N; 292/262, 264, 288–298

[56] References Cited

UNITED STATES PATENTS

| | | | |
|---|---|---|---|
| 546,102 | 9/1895 | Jenkins | 292/264 |
| 572,046 | 11/1896 | Bailey | 292/288 |
| 1,523,287 | 1/1925 | Rawlins | 24/116 R |
| 2,199,369 | 4/1940 | Bernstein | 292/262 X |
| 2,457,195 | 12/1948 | Bagnall | 24/116 R X |
| 3,313,566 | 4/1967 | Sipes | 292/292 |
| 3,804,454 | 4/1974 | Simmons | 292/262 |
| 3,891,257 | 6/1975 | Wilson | 292/262 |

FOREIGN PATENTS OR APPLICATIONS

| | | | |
|---|---|---|---|
| 16,975 | 7/1904 | Austria | 292/264 |
| 292,969 | 7/1916 | Germany | 24/135 N |
| 461,055 | 2/1937 | United Kingdom | 24/135 N |

*Primary Examiner*—Lawrence J. Staab

[57] ABSTRACT

This invention pertains to a portable security lock having a sliding fastener and chain that loops around the doorknob stem and a hook that connects to the striker plate and the chain so that when the door is closed, the lock cannot be jimmied or removed unless the portable security lock is removed.

2 Claims, 2 Drawing Figures

PORTABLE SECURITY LOCK

BACKGROUND OF THE INVENTION

1. Field of the Invention

This invention relates generally to security locks and, more particularly, to a portable security lock that attaches to the striker plate and the doorknob stem to securely hold the door in a closed and locked position.

2. Description of the Prior Art

Briefly, the concept of security locks is old in the art as evidenced by the number of security locks and patents on various types of security locks. A typical type of security lock device is shown in the Connigan U.S. Pat. No. 2,726,112 in which a chain and special striker plate are used to secure the door. Another type of device is shown on the Jones Patent, U.S. Pat. No. 366,843 which shows a flat plate with a protuberance for fastening to a striker cap.

Briefly, these prior art security locks have a drawback in that they are either not entirely portable, require a special type of lock or striking plate, or cannot be securely and tightly fastened; that is, the door can be bumped back and forth even though the lock is in place.

The present invention comprises a portable security lock that contains a hook for fastening to virtually any striker plate and a chain and fastening member which can be securely snugged around the doorknob stem. The advantage of the present invention is that a traveler can place the lock on a hotel door, a motel door or on a door which does not have a lock without having to alter or change the existing striker plate on the door jamb.

DESCRIPTION OF THE PREFERRED EMBODIMENT

Figure 1:
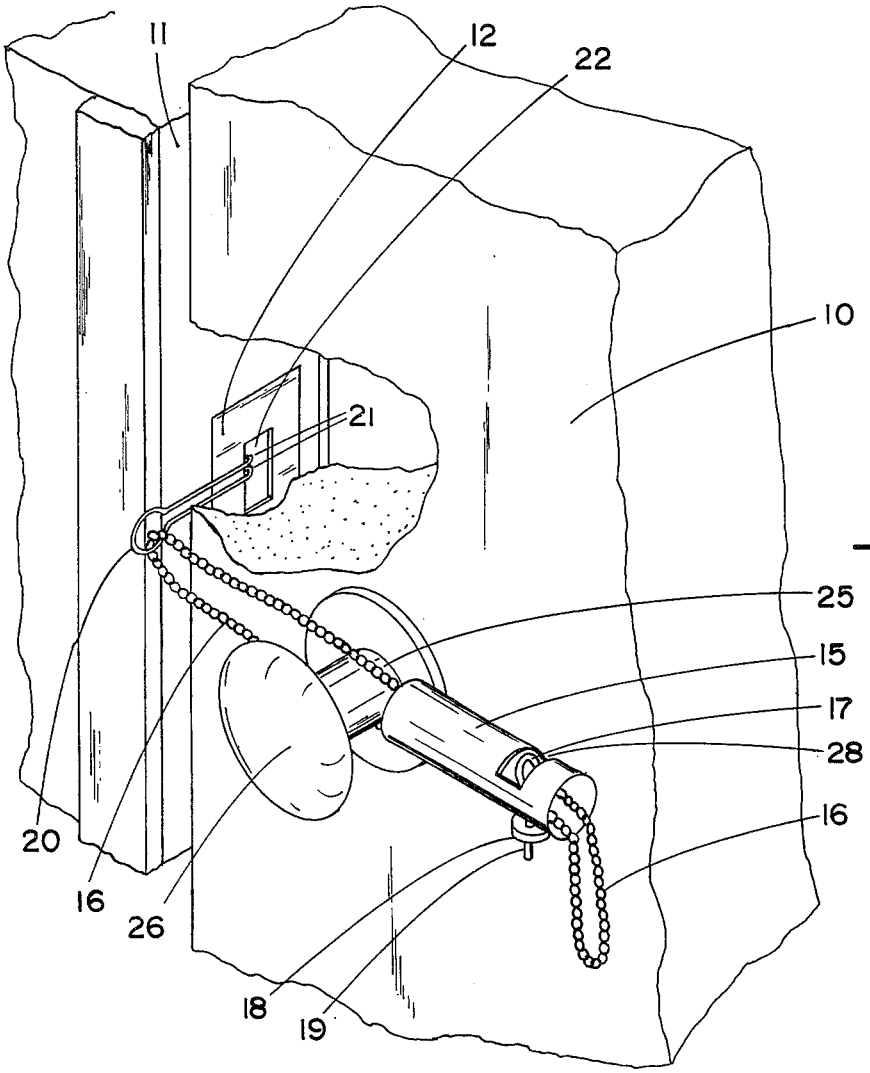
FIG. 1 shows a cutaway view of the lock.

Referring to FIG. 1, reference numeral 10 designates a portion of a door, which opens toward the viewer, and a door jamb 11. Located in door jamb 11 is a striker plate 12 having an opening 22 therein for receiving a conventional door latch (not shown). Fastened in opening 22 is a U shaped member 20 having the ends bent to produce a pair of hooks 21 for engaging the edge of striker plate 12. Member 20 comprises a fairly thin yet substantially stiff member that will fit in the normal clearance space between door jamb 11 and the edge of door 10 when door 10 is in the closed position.

Typically, I have found that with 29 gauge piano wire for forming member 20, I can bend the ends to produce a pair of hooks that will withstand the force of someone attempting to break down the door as well as being sufficiently thin so as to fit in the clearance between door jamb 11 and closed door 10. In conventional doors, I have found that the striker plate or jamb will break before my portable security lock will break.

Connected to member 20 is a single strand of link chain 16 which passes over door stem 25 through a cylindrical conduit 15 in a first direction, then through a cylindrical conduit 15 in the opposite direction. The chain then passes under stem 25 and again fastens to member 20.

Figure 2:
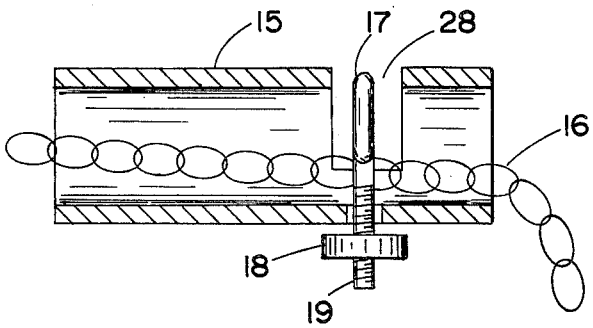
FIG. 2 shows a sectional view of the chain lock fastening member.

Conduit 15 has a cutaway section 28 therein where an eye bolt 17 is centrally located. On each side of eye bolt 17 is a strand of the chain 16. Eye bolt 17 contains a threaded section 18 and a knurled nut 18 which can be turned to draw the eye of eye bolt 17 into frictional contact with chain 16 and thus lock the strands of the chain against conduit 15. When the knurled nut is loosened, eye bolt 17 can be moved upward (FIG. 2) which allows chain 16 to slide freely past eye bolt 17. The use of a ½inch diameter conduit and a 3/16 eye bolt in conjunction with about 18 inches of single strand link chain 16 produces a portable security lock which will fit most doors and door jambs as well as providing sufficient strength to hold the door from being broken open. It should be pointed out that any type of chain can be used but the smaller links are preferred because they can be fastened more snugly around the eye bolt.

In operation of the present invention, the user merely fastens hooks 21 to the striker plate opening 22 and then closes door 10. Closing door 10 holds member 20 between door jamb 11 and the edges of the door 10 so that member 20 cannot be removed unless the door is opened. Next, chain 16 is looped over door stem 25 as shown in FIG. 1. After chain 16 has been looped over door stem 25, conduit 15 is slid toward door stem 25. When conduit 15 has been snugged up tightly to door stem 25, the operator tightens knurled nut 18 which fastens the chain 16 to cylindrical member 15. By doing so, the operator is securely and tightly holding door 10 in a closed position, that is, there is no slack in chain 16 between member 20 and door stem 25. If someone attempts to open the door, by pushing toward the viewer (FIG. 1), it is apparent that the portable security lock is securely and firmly holding the door from even moving. That is, the door lock holds the door 10 so tightly that it prevents anyone from bumping the door back and forth to break it open. Thus, a great degree of security is obtained with my lock which not only is portable but securely locks a door. If a door latch lock is also present, the user obtains the benefit of both locks working together to obatin a double barrier. Furthermore, since member 20 cannot come out unless door 10 is opened, my lock is virtually impossible to pick or circumvent.

A further advantage is that my lock is as strong as the door itself. That is, if someone is to gain entrance, it must be by smashing door 10 or jamb 11 rather than attempting to break my lock. Thus, the stronger and more rigid the door and frame, the more protection my portable security lock offers.

I claim:

1. A portable security lock for a swinging door comprising:

a first member having a hook on one end for engagement in a striker plate, said first member made from material having sufficient thinness so as to fit between the striker plate and the edge of the door when the door is in a closed position;

a chain connected to said first member, said chain operable for fastening around a doorknob;

a fastening member for attaching to said chain, said fastening member including an open ended cylindrical member comprised of a section of conduit;

said cylindrical member having a portion of said chain passing therethrough;

said fastening member including a chain gripping member comprising an eye bolt and a knurled nut located thereon for fastening said chain to said cylindrical member so that said chain can be shortened by sliding said cylindrical member toward said first member, said chain gripping member operable for securely holding the chain within said cylindrical member to prevent a door from being opened.

2. The invention of claim 1 wherein said chain comprises two strands of chain for passing through said open cylindrical member.

* * * * *